US012721421B2

(12) United States Patent
Darby et al.

(10) Patent No.: US 12,721,421 B2
(45) Date of Patent: Sep. 1, 2026

(54) TOP MOUNTING WIRE CLIP

(71) Applicant: ULTICLIP, LLC, Orlando, FL (US)

(72) Inventors: Randall Lynn Darby, Euless, TX (US); Clayton Andrew Bass, Bourbonnais, IL (US)

(73) Assignee: ULTICLIP, LLC, Orlando, FL (US)

( * ) Notice: Subject to any disclaimer, the term of this patent is extended or adjusted under 35 U.S.C. 154(b) by 168 days.

(21) Appl. No.: 18/946,355

(22) Filed: Nov. 13, 2024

(65) Prior Publication Data

US 2026/0130490 A1 May 14, 2026

(51) Int. Cl.
*A45F 5/02* (2006.01)

(52) U.S. Cl.
CPC ..... *A45F 5/021* (2013.01)

(58) Field of Classification Search
CPC ... B62J 11/04; A45F 5/02; A45F 5/021; A45F 5/1566; A45F 5/1575; B42F 1/08; F16B 2/248; F16B 39/10; F16B 39/108; F16B 43/00; Y10T 24/205; Y10T 24/206; Y10T 24/392; Y10T 24/3931
USPC ..... 24/546, 555; 224/248, 666–670
See application file for complete search history.

(56) References Cited

U.S. PATENT DOCUMENTS 2,908,954 A * 10/1959 Chaun ..... B42F 1/08 24/67.9
3,361,312 A * 1/1968 Hutchison ..... A45C 1/04 224/677
4,214,686 A * 7/1980 Dostourian ..... A45F 5/021 24/546
4,237,587 A * 12/1980 Hsiao ..... B42F 1/08 24/67 R
4,690,315 A * 9/1987 Bianchi ..... F41C 33/041 224/661
5,176,302 A * 1/1993 Smith ..... A45F 5/02 224/678
5,216,418 A * 6/1993 Lenz ..... G08B 7/062 340/384.1
5,402,555 A * 4/1995 Boland ..... F16G 11/046 24/131 R
5,511,705 A * 4/1996 Dreszer ..... A45F 5/02 224/678
7,140,148 B1 * 11/2006 Williams, II ..... A01K 97/06 248/302
9,451,821 B1 * 9/2016 Estigoy ..... A45F 3/005
12,256,828 B1 * 3/2025 Holmes ..... A45F 5/021

* cited by examiner

*Primary Examiner* — Corey N Skurdal
(74) *Attorney, Agent, or Firm* — INNOVATION CAPITAL LAW GROUP, LLP; Vic Lin

(57) ABSTRACT

A clip allows users to adjust the angle at which the clip is mounted, provides adjustability to allow a varying width of belts or webbing and is captured by a unique retention washer to the object on which the clip is mounted.

19 Claims, 14 Drawing Sheets

TOP MOUNTING WIRE CLIP

BACKGROUND OF THE INVENTION

1. Field of the Invention

Embodiments of the present invention generally relate a clip that allows a user to be able to securely carry items by providing an attachment point to a belt or webbing, as well as providing a way to grip onto fabric or material. The clip can be attached to a variety of objects, by means of, but not limited to a screw, bolt and nut, or other kinds of fasteners. The clip can be utilized to, but not limited to, carry pouches, bags, holsters, knives, cases, or an item that one would wish to attach to one's belt, pocket, fabric, clothing, bag, wearable object, or pack.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

There are a variety of clips formed out of metal or plastic. Metal clips can be formed out of flat strips of metal, bent wire, or formed plastic. Bent wire clips have been created in many forms, however, presently they are not configured to have eyelets at the top of the clip that use retaining washers that capture the mounting area of the clip. There is no present wire clip that combines the ability to mount to mounting holes, such as horizontal mounting holes, at varying spacing, allows the user to adjust the height and angle of the clamping area of the clip, and uses retaining washers to capture the mounting portion of the clip.

In view of the foregoing, there is a need for a clip that can address the deficiencies of conventional clips.

SUMMARY OF THE INVENTION

Embodiments of the present invention aim to solve the aforementioned problems with conventional clips by providing a clip that is configured to have eyelets at the top of the clip that uses retaining washers that capture the mounting area of the clip. The clip can combine the ability to mount to mounting holes, including horizontal mounting holes, at varying spacing, to allow the user to adjust the height and angle of the clamping area of the clip, and to use retaining washers to capture the mounting portion of the clip.

According to aspects of the present invention, a user can secure an object to a belt, clothing, or wearable object utilizing a clip that combines the following features, which are discussed in greater detail below, in connection with the associated figures. This device provides adjustability in the clamping area for various widths of belt or webbing. It allows for the adjustment of the angle of the clamping area in relation to the object to which it is mounted. On the object that the clip is mounted to, the distance between the mounting holes can vary, due to the flexibility of the clip. The clip also utilizes unique channeled retaining washers that securely capture the mounting eyelets of the clip.

Embodiments of the present invention provide a clip system comprising a clip component comprising first and second clip eyelets spaced apart from each other; first and second clip legs extending downward from respective first and second clip eyelets; and a clip return formed by forming a clip return bend in each of the first and second clip legs, angling each of the first and second clip legs upward, and interconnecting ends of the first and second clip legs; and first and second clip retaining washers comprising a mounting hole formed through a thickness of each of the first and second clip retaining washers; and a cutout formed by partially removing the thickness of each of the first and second clip retaining washers from one side to an opposite side thereof, thus forming a channel with the cutout; wherein each of the first and second clip retaining washers fit over each respective ones of the first and second clip eyelets, with each of the first and second clip eyelets fitting into the cutout, and the mounting hole aligning with the first and second clip eyelets, permitting a fastener to be inserted through the mounting hole, through respective first and second clip eyelets, and to an object on which the clip system is mounted.

Embodiments of the present invention provide a clip system comprising a clip component comprising first and second clip eyelets spaced apart from each other; first and second clip legs extending downward from respective first and second clip eyelets; and a clip return formed by forming a clip return bend in each of the first and second clip legs, angling each of the first and second clip legs upward, and interconnecting ends of the first and second clip legs; and first and second clip retaining washers comprising a mounting hole formed through a thickness of each of the first and second clip retaining washers; and a cutout formed by partially removing the thickness of each of the first and second clip retaining washers from one side to an opposite side thereof, thus forming a channel with the cutout, wherein the first and second clip eyelets are formed in an oblong shape, the oblong shape having a major axis extending along a vertical direction of the clip; each of the first and second clip retaining washers fit over each respective ones of the first and second clip eyelets, with each of the first and second clip eyelets fitting into the cutout, and the mounting hole aligning with the first and second clip eyelets, permitting a fastener to be inserted through the mounting hole, through respective first and second clip eyelets, and to an object on which the clip system is mounted; the first and second clip legs have a clip leg spacing between the clip legs that narrows from the first and second clip eyelets to the clip return; and the first and second clip legs each have a clip leg bend that bend each of the first and second clip legs as a clip leg bend angle.

Embodiments of the present invention provide a fastening system for retaining a first object on a second object, comprising a clip component comprising first and second clip eyelets spaced apart from each other; first and second clip legs extending downward from respective first and second clip eyelets; and a clip return formed by forming a clip return bend in each of the first and second clip legs, angling each of the first and second clip legs upward, and interconnecting ends of the first and second clip legs; first and second clip retaining washers comprising a mounting hole formed through a thickness of each of the first and second clip retaining washers; and a cutout formed by partially removing the thickness of each of the first and second clip retaining washers from one side to an opposite side thereof, thus forming a channel with the cutout; first and second fasteners operable to extend through the mounting holes, through respective first and second eyelets, and into the first object to mount the clip component to the first object; and a space defined between the first and second legs, the clip return, and the first object, the space operable to removably receive the second therein to attach the first object to the second object, wherein the first and second clip eyelets are formed in an oblong shape, the oblong shape having a major axis extending along a vertical direction of the clip; and each of the first and second clip retaining washers fit over each respective ones of the first and second clip eyelets, with each of the first and second clip eyelets fitting into the cutout, and the mounting hole aligning with the first and second clip eyelets.

In some embodiments, a height of the space is adjustable due to the oblong shape of the first and second clip eyelets.

In some embodiments, the first object is selected from the group consisting of a pouch, a bag, a holster, a knife, and a case, and the second object is selected from the group consisting of a belt, a pocket, a fabric, an article of clothing, a bag, a wearable object, or a pack.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
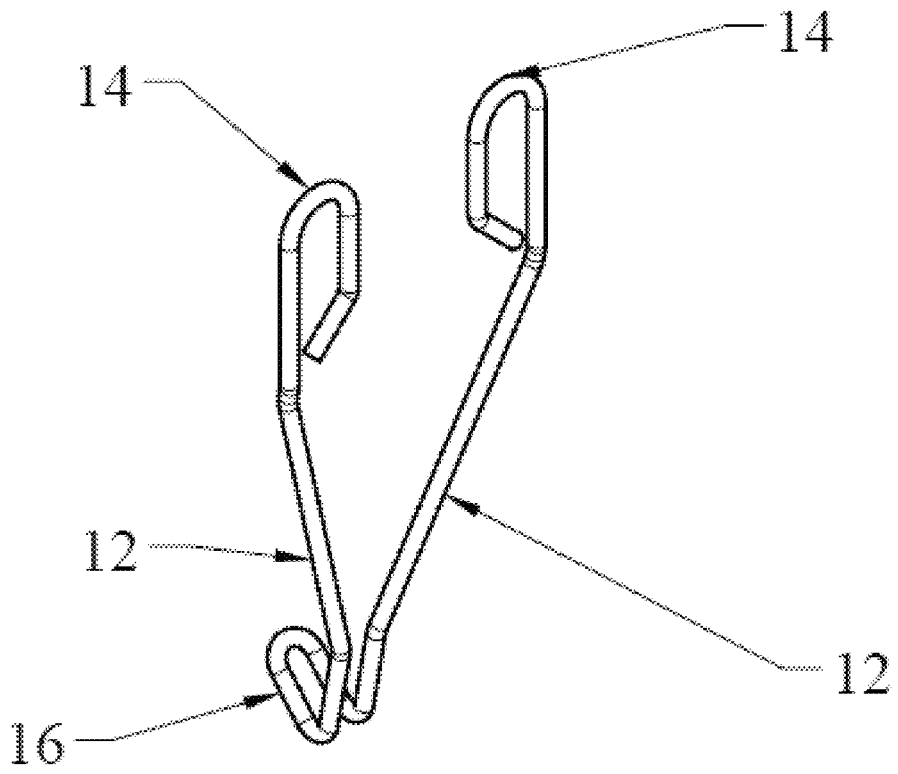
FIGS. 1A through 1C show an isometric, front, and side view, respectively, of the clip component of the clip system according to aspects of the present invention.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a clip that allows users to adjust the angle at which the clip is mounted, provides adjustability to allow a varying width of belts or webbing and is captured by a unique retention washer.

The clip system can be, but is not limited to, being composed of two components that create a single entity. The two components of the clip system, the clip component and the retention washer, can be constructed out of metal, composite, or plastic, for example. Each component listed would typically be formed out of a single piece of the desired material and assembled as described below.

Figure 1B:
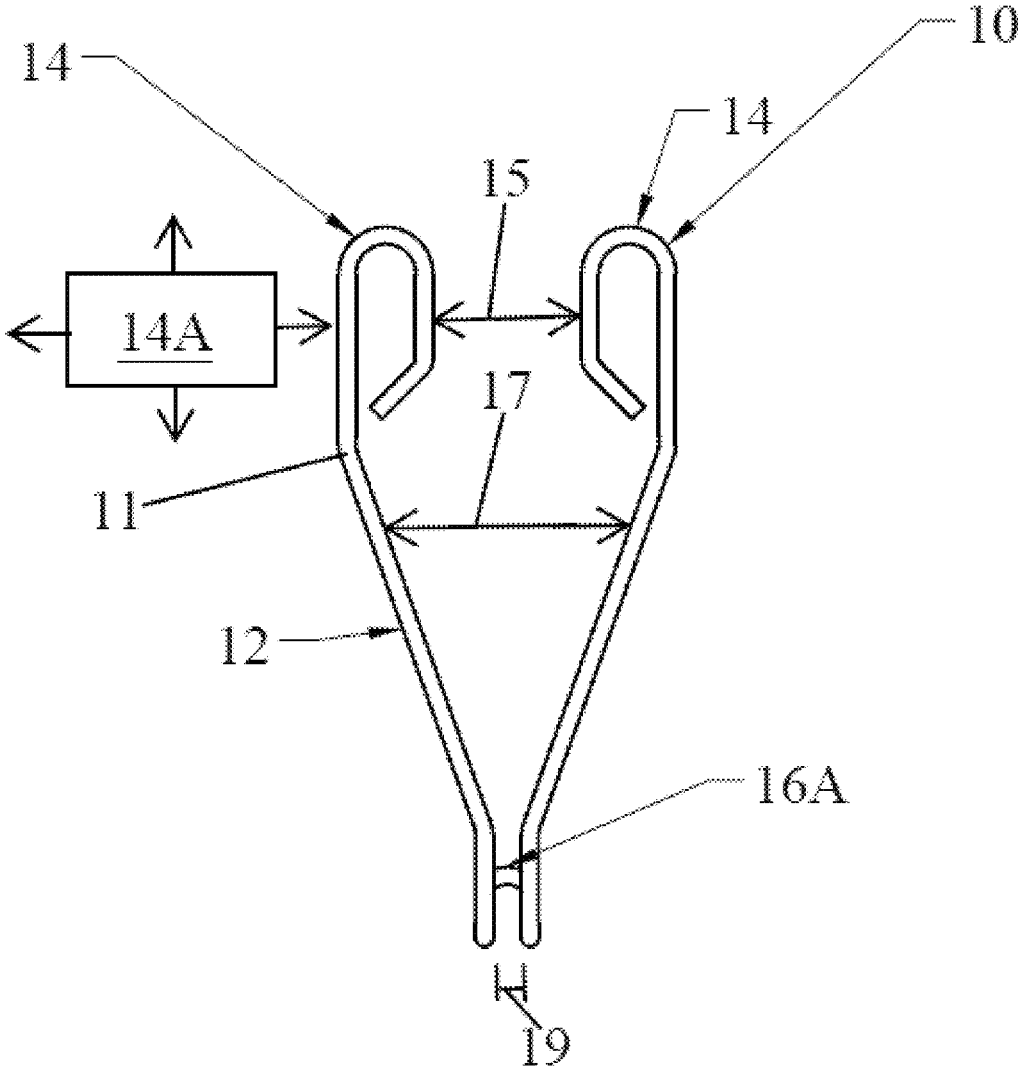
Figure 1C:
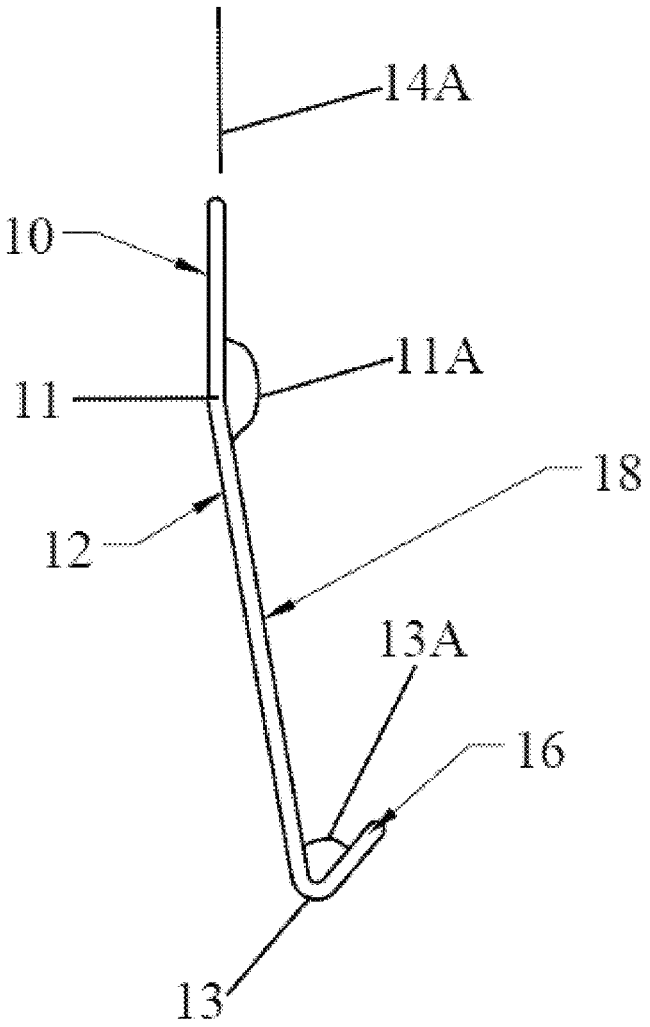

Referring to FIGS. 1A through 1C, a clip component 10 can include clip legs 12, clip eyelets 14, a clip return 16, and a clip belt space 18. The two clip eyelets 14 are formed at the top of the clip component 10 by creating an elongated circle or oval. The clip eyelet 14 provides an area that can be captured by a screw, bolt, or some other form of hardware to attach the clip component 10 to the user's desired object. As shown in FIG. 1B, the clip eyelet 14, clip leg 12, and clip return 16 can be viewed. As seen in FIG. 1C, the clip belt space 18 is formed by the area below the clip eyelets 14, the length of the clip leg 12, and above the clip return 16. The clip belt space 18 is where a belt, webbing, fabric, or material would be captured and held by the clip component 10.

Figure 3A:
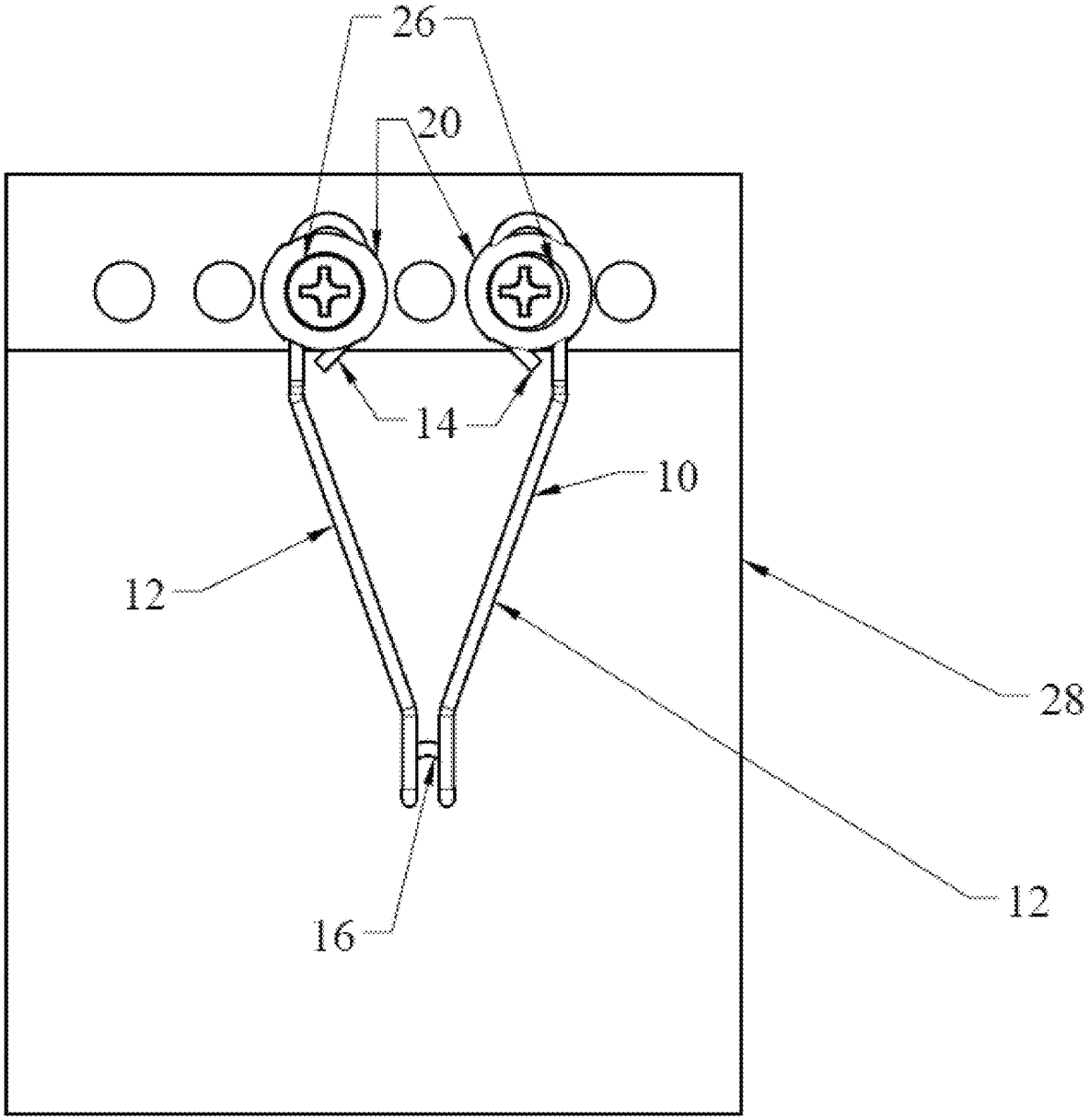
FIGS. 3A and 3B show a front and side view, respectively, of the clip system mounted to an object using the channeled retaining washer and the clip component.

As can be seen in FIGS. 1A through 1C, the clip component 10 can include two clip eyelets 14, spaced apart by an eyelet spacing 15. As described below, the clip component 10 can have sufficient flexibility so that the eyelet spacing 15 may be adjusted by the user. The clip eyelets 14 may be formed from partially encircling the material of the clip component 10 at respective ends thereof. In some embodiments, the clip component 10 may be formed from a single, unitary piece of material, bent or formed into the design shown in the Figures. The clip eyelets 14 may each define a clip eyelet plane 14A, where the clip eyelet plane 14A of each of the clip eyelets 14 may be aligned, as best illustrated in FIG. 1C. The clip eyelet plane 14A may be best illustrated in FIG. 1B, where the clip eyelet plane 14A may align with the drawing sheet, or in FIG. 1C, where the clip eyelet plane 14A is orthogonal to the drawing sheet. The clip eyelets 14 may be disposed in a horizontal line, as best illustrated in FIGS. 1B and 3A, for example, or may be offset from horizontal.

The clip eyelets 14 may integrally attach to the clip legs 12. An eyelet bend 11 may be formed in the clip legs 12, adjacent the clip eyelets 14, to bend each of the clip legs 12, equally, out of the clip eyelet plane 14A. The eyelet bend 11 may have an eyelet bend angle 11A from about 130 to about 175 degrees, typically from about 150 to about 170 degrees, for example. The eyelet bend angle 11A may at least partially define the depth of the clip belt space 18.

At a distal end of the clip legs 12 (relative to the eyelets 14 being at a proximal end thereof), a return bend 13 may be formed, equally, in each of the clip legs 12 to form the clip return 16. A return bend angle 13A may be from about 10 to 85 degrees, typically from about 30 to about 80 degrees, for example. The clip return 16 may integrally attached each end of the material forming the clip component 10. Typically, a rounded end 16A may be formed at the distal end of the clip component 10. The clip return angle 13A may direct the rounded end 16A upward, where the direction of the clip legs 12, extending from the clip eyelets 14, is defined as downward.

The clip eyelets 14 may be spaced apart from each other by a clip eyelet spacing 15. A clip leg spacing 17 may narrow as the clip legs 12 extend from the clip eyelets 14 to the clip return 16. The clip return 16 may be defined with a clip return spacing 19.

Figure 2A:
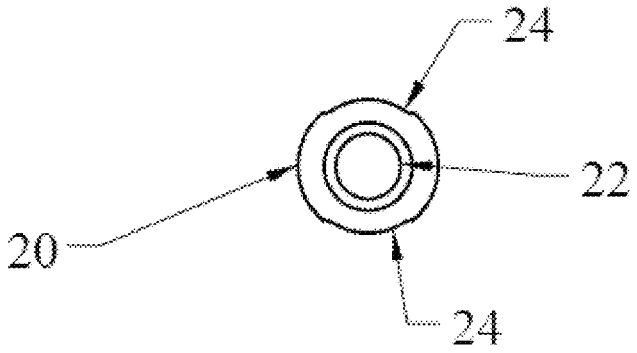
FIGS. 2A through 2D show a front, isometric, top, and side view, respectively, of a channeled retaining washer component of the clip system according to aspects of the present invention.
Figure 2B:
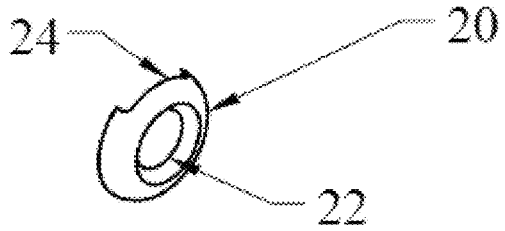
Figure 2C:
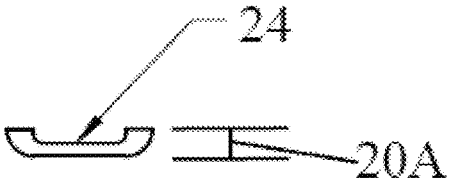
Figure 2D:
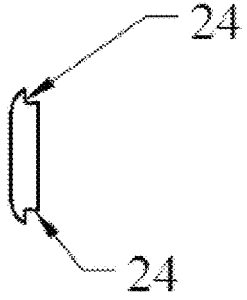
Figure 7A:
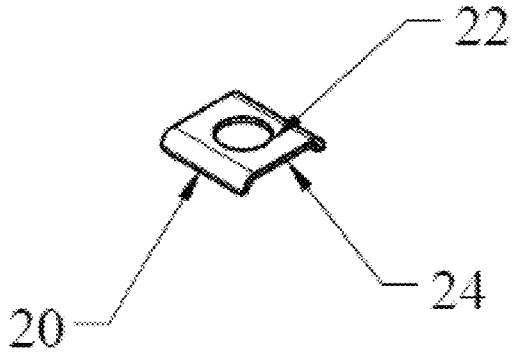
FIGS. 7A through 7C show an isometric, side and top view, respectively, of an embodiment of the channeled retaining washer.
Figure 7B:
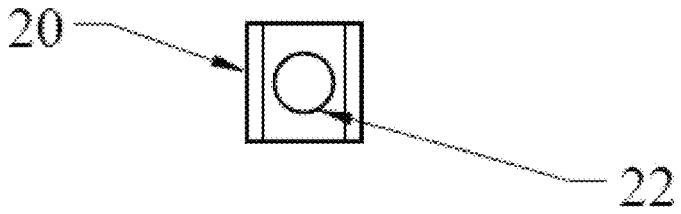
Figure 7C:
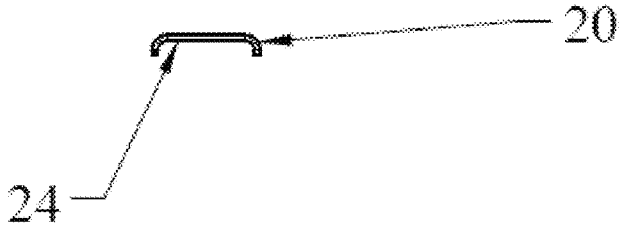
Figure 8A:
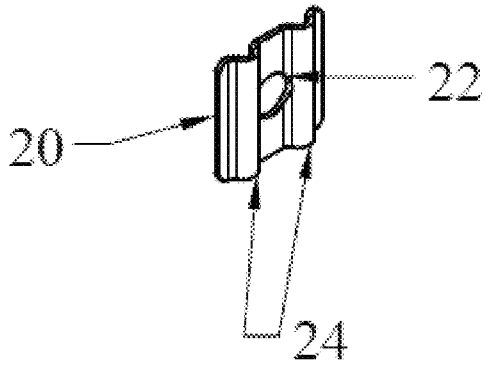
FIGS. 8A through 8C show an isometric, side and top view, respectively, of an embodiment of the channeled retaining washer.
Figure 8B:
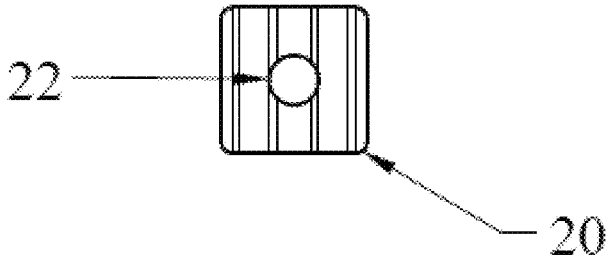
Figure 8C:
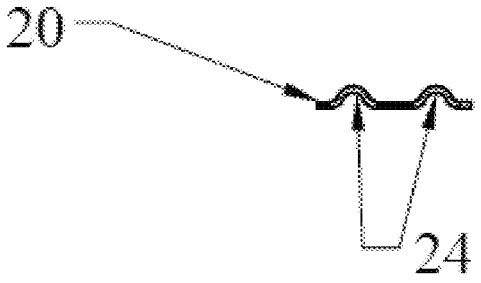

Referring to FIGS. 2A through 2D, the channeled retaining washer 20 is illustrated. FIG. 2A illustrates a front view of the channeled retaining washer 20. A central through hole forms the retaining washer mounting hole 22 in the channeled retaining washer 20 and allows it to be secured using a bolt, screw, or other fastening methods. In FIGS. 2A through 2D, the retaining washer cutout 24 can be seen. The cutout 24 is located in the bottom portion of the channeled retaining washer 20 and passes through both sides. The retaining washer cutout 24 provides a space for the clip eyelet 14 to be captured by the channeled retaining washer 20 when a fastening device is passed through the retaining washer mounting hole 22 and the clip eyelet 14. Two other possible embodiments of the channeled retaining washer 20 and its features are depicted in FIGS. 7A through 7C and in FIGS. 8A through 8C.

The retaining washer 20 can have a thickness 20A. The retaining washer cutout 24 may be formed by removing a portion of the thickness 20A from opposing sides of the retaining washer 20. The thickness 20A may be uniformly disposed throughout the retaining washer 20 (except where not present due to the retaining washer cutout 24), or may be present only partially throughout the entirety of the retaining washer 20. Regardless of the design, the retaining washer cutout 24 may have a width 24A that can capture the clip eyelet 14 (see FIGS. 3A and 3B) therein, as discussed in greater detail below.

Figure 3B:
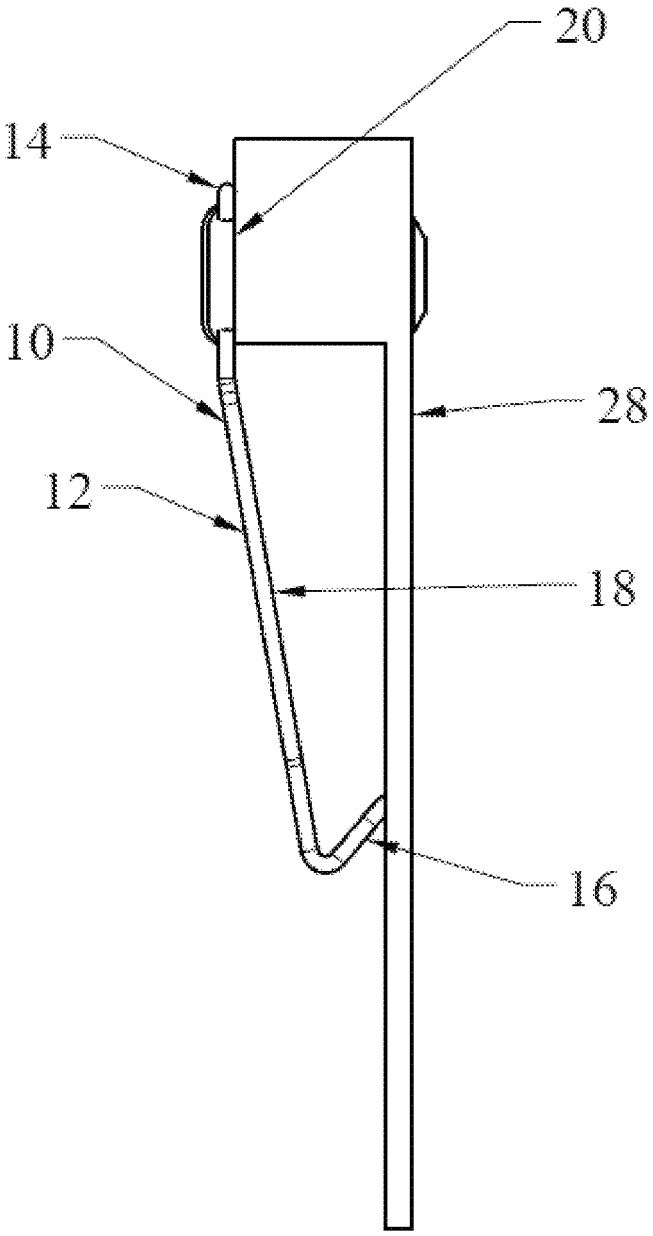

Referring to FIGS. 3A and 3B, a method of using the clip system is illustrated. In both clip eyelets 14, a channeled retaining washer 20 is placed so that the retaining washer cutout 24 captures both sides of the clip eyelet 14. A screw 26 is passed through the retaining washer mounting hole 22 to secure the channeled retaining washer 20 over the clip eyelet 14 and fasten the clip component 10 to the object 28. This method ensures that the clip component 10 is securely captured to the object 28. The distance of the belt space 18 can be varied because of the oblong shape of the clip eyelets 14. The oblong shape may be defined as having a major axis that extends generally vertically, where vertically is defined as the vertical direction of the clip illustrated in FIGS. 1B and 1C. Vertical is not limited to strictly up and down, but, instead, refers to a direction that includes a vertical component. For example, vertical may be formed at an angle from being orthogonal to horizontal, provided that there is the ability to move the clip vertically once mounted. This allows the clip component 10 to accommodate varying widths of a belt or webbing by adjusting the position of the screw 26 and channeled retaining washer 20 position in the clip eyelet 14. This feature will be described further below.

Figure 4A:
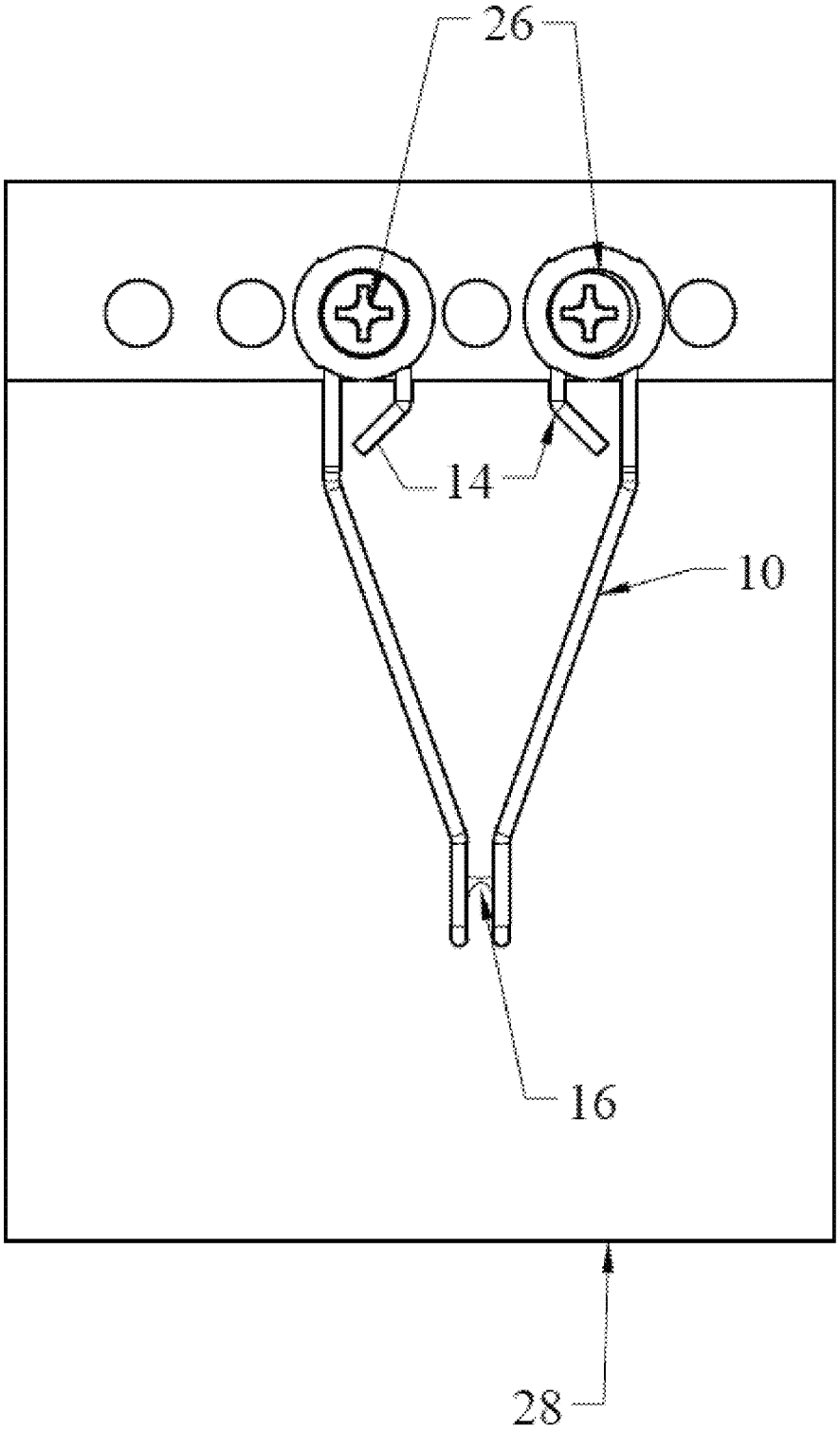
FIGS. 4A through 4C show two front views and a side view, respectively, of the clip system, illustrating the clip system ability to adjust to different belt or webbing widths.
Figure 4B:
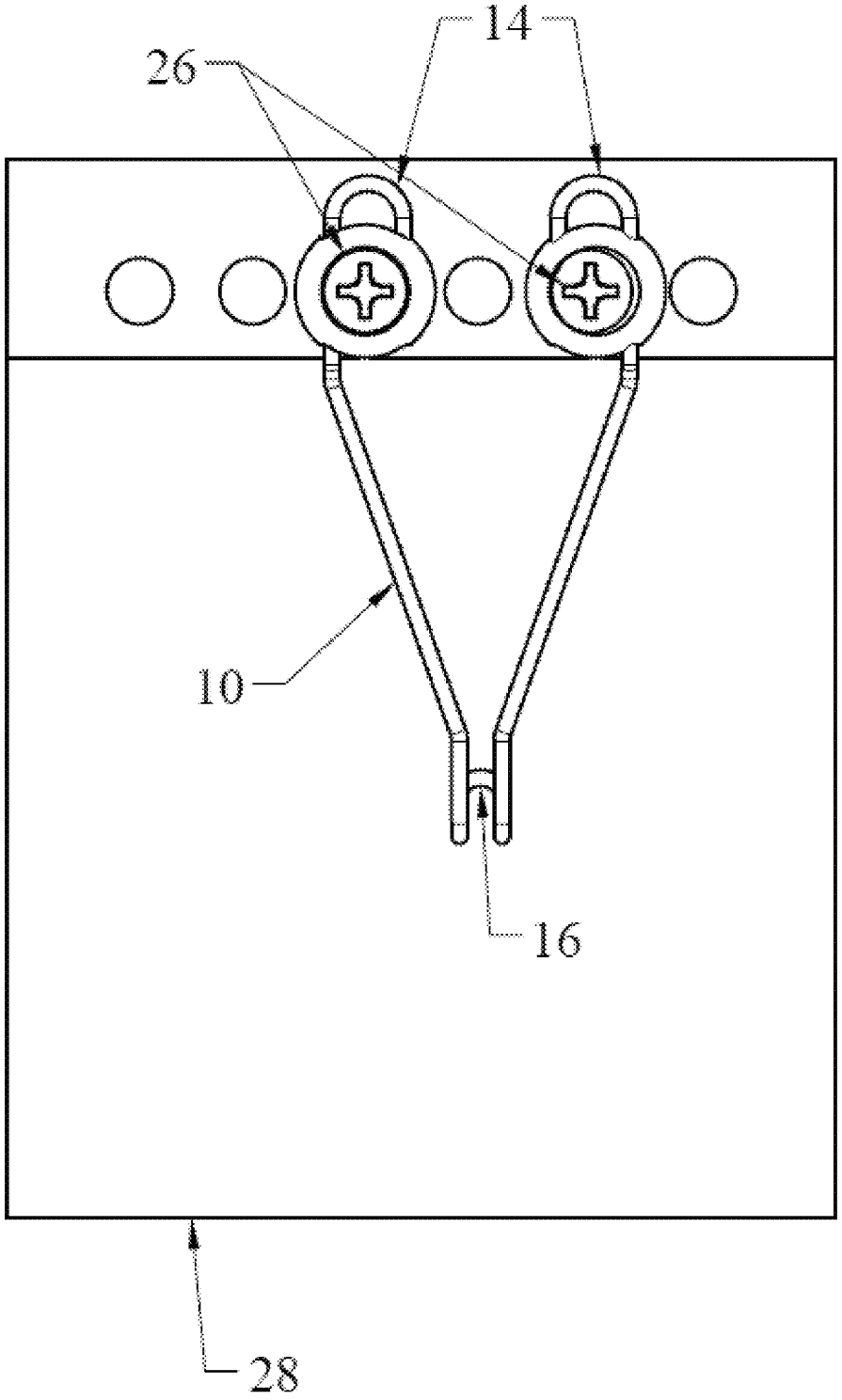
Figure 4C:
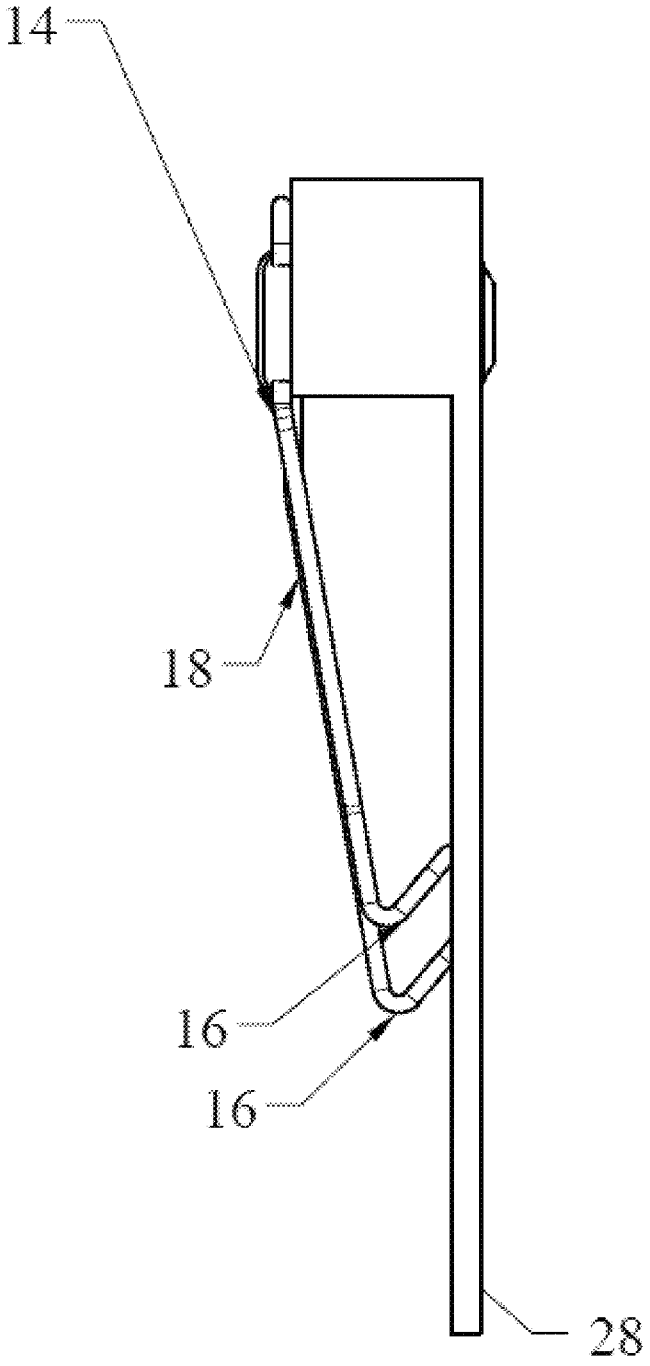

Referring now to FIGS. 4A through 4C, it is illustrated how the elongated clip eyelet 14 of the clip system allows the position of the clip component 10 to be adjusted vertically in relation to the object 28 on which it is mounted. As seen in FIG. 4A, the clip component 10 is mounted in the lowest position in relation to the object 28. The top portion of the clip eyelet 14 is captured by the screw 26 and the channeled retaining washer 20. This allows the clip system to capture a wider-width belt or webbing. In FIG. 4B, the clip component 10 is mounted in the highest position in relation to the object 28. The bottom portion of the clip eyelet 14 is captured by the screw 26 and the channeled retaining washer 20. This allows the clip system to capture a narrower-width belt or webbing. In FIG. 4C, the distance between the clip return 16 to the clip eyelet 14 of the clip component 10 is shown when the clip component 10 is in both mounting positions (of FIG. 4A and FIG. 4B). The clip component 10 can be mounted in any position between the illustrated top and bottom positions shown in FIG. 4A and FIG. 4B. This allows the belt space 18 to accommodate varying widths of belts, webbing, or the like.

Figure 5A:
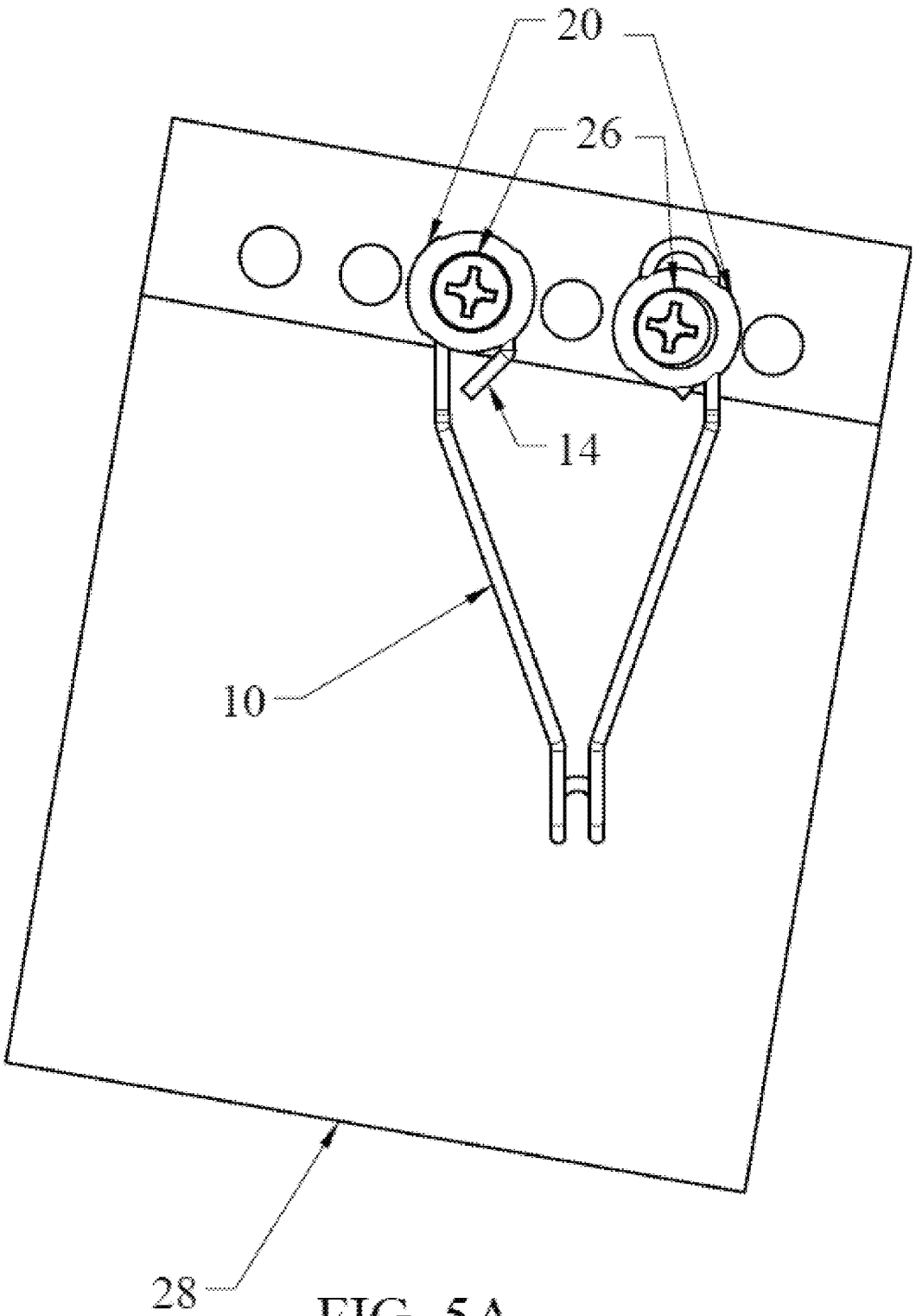
FIGS. 5A and 5B show two front views of the clip system, demonstrating its ability to be mounted at varying angles on an object.
Figure 5B:
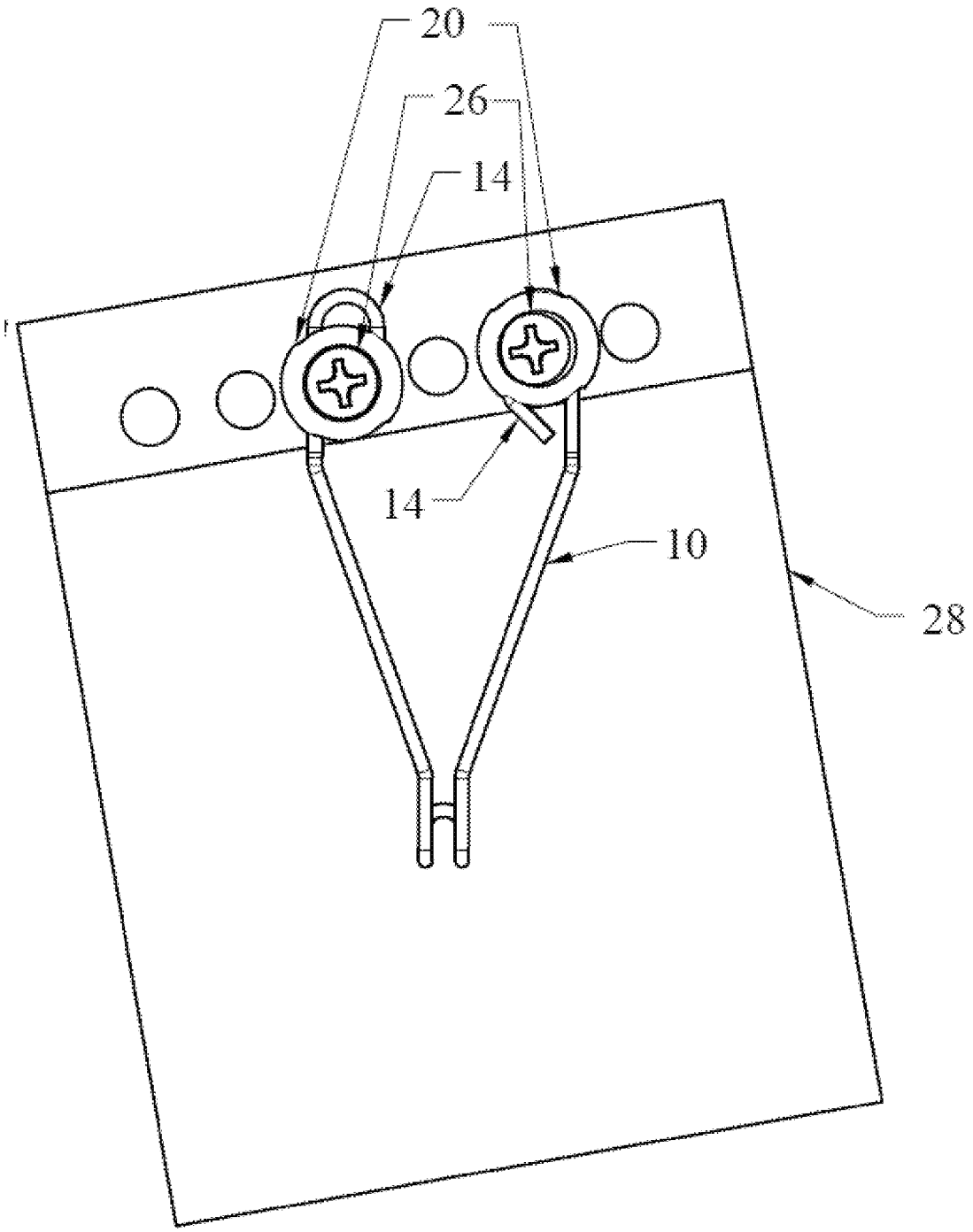

Referring to FIGS. 5A and 5B, it is shown how the clip component 10 can be pivoted at an angle in relation to the object due the elongated clip eyelet 14. As seen in FIG. 5A, the clip component 10 is angled to the right direction in relation to the object 28. The top of the left clip eyelet 14 of the clip component 10 is captured by the screw 26 and the channeled retaining washer 20 and the bottom of the right clip eyelet 14 is captured by the screw 26 and the channeled retaining washer 20. This allows the clip component 10 to pivot in relation to the object 28. As seen in FIG. 5B, the clip component 10 is angled in the left direction in relation to the object 28. The top of the right clip eyelet 14 of the clip component 10 is captured by the screw 26 and the channeled retaining washer 20 and the bottom of the left clip eyelet 14 is captured by the screw 26 and the channeled retaining washer 20. This allows the clip component 10 to pivot in relation to the object 28. The clip component 10 can be pivoted in a multitude of angles relative to the object 28 between the left-most and right-most positions relative to the object 28.

Figure 6:
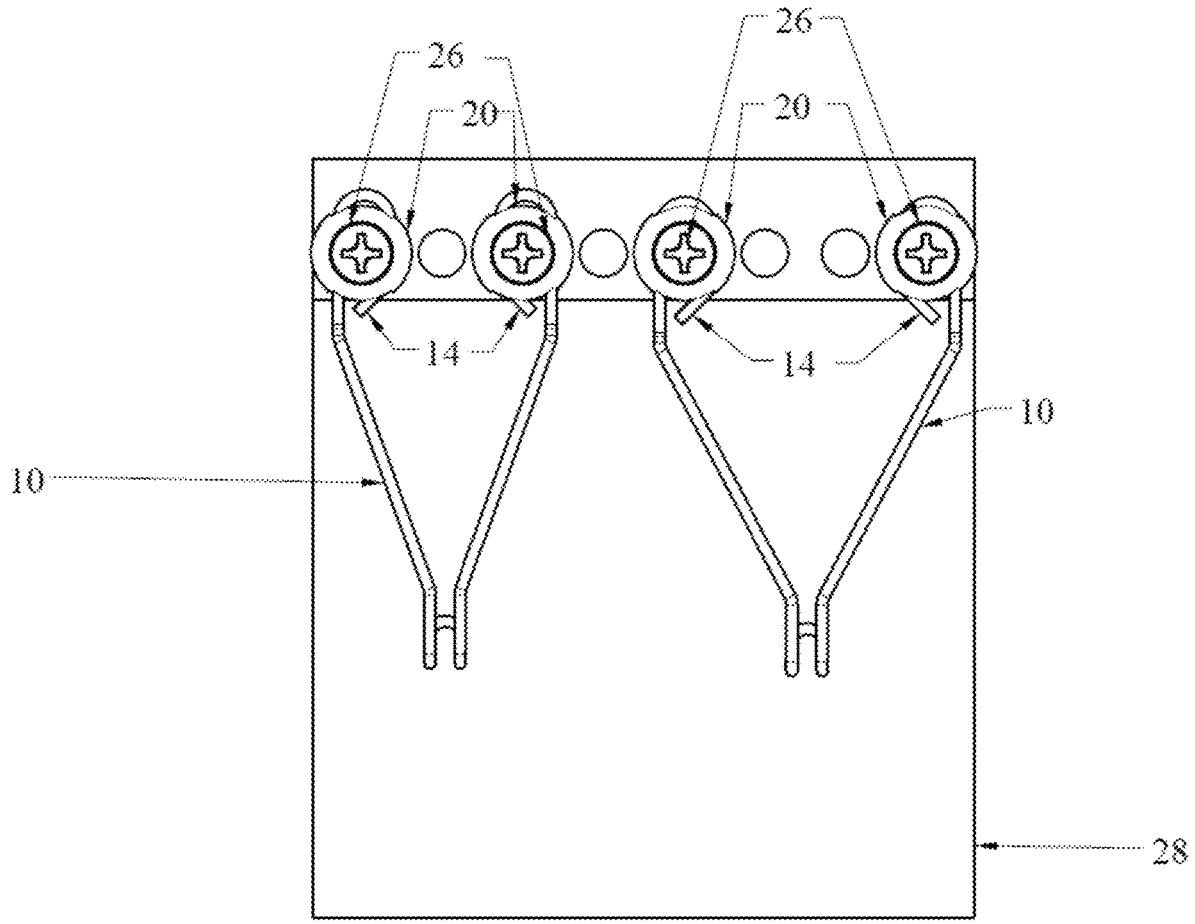
FIG. 6 shows a front view of two of the clip systems, showing its ability to be mounted to various widths of mounting locations.

FIG. 6 illustrates the ability of the clip system to flex and be mounted to various widths of mounting locations. The clip component 10, on the left, is mounted on narrow mounting holes on the object 28 using the screw 26 and the channeled retaining washer 20 through the two clip eyelet 14. The clip component 10, on the right, is mounted on wide mounting holes on the object 28 using the screw 26 and the channeled retaining washer 20 through the two clip eyelet 14. The flexibility of the clip component 10 allows the clip component 10 to adjust to many different widths of mounting holes.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A clip system comprising:

a clip component comprising:

first and second clip eyelets spaced apart from each other;

first and second clip legs extending downward from respective first and second clip eyelets; and a clip return formed by forming a clip return bend in each of the first and second clip legs, angling each of the first and second clip legs upward, and interconnecting ends of the first and second clip legs; and first and second clip retaining washers comprising:

a mounting hole formed through a thickness of each of the first and second clip retaining washers; and a cutout formed by partially removing the thickness of each of the first and second clip retaining washers from one side to an opposite side thereof, thus forming a channel with the cutout;

wherein each of the first and second clip retaining washers fit over each respective ones of the first and second clip eyelets, with each of the first and second clip eyelets fitting into the cutout, and the mounting hole aligning with the first and second clip eyelets, permitting a fastener to be inserted through the mounting hole, through respective first and second clip eyelets, and to an object on which the clip system is mounted.

2. The clip system of claim 1, wherein the first and second clip legs have a clip leg spacing between the clip legs that narrows from the first and second clip eyelets to the clip return.

3. The clip system of claim 1, wherein the first and second clip legs each have a clip leg bend that bend each of the first and second clip legs as a clip leg bend angle.

4. The clip system of claim 3, wherein the clip leg bend angle is from about 130 to about 175 degrees.

5. The clip system of claim 1, wherein the first and second clip eyelets are formed in an oblong shape, the oblong shape having a major axis extending along a vertical direction of the clip.

6. The clip system of claim 1, wherein the retaining washer has a round shape.

7. The clip system of claim 1, wherein the retaining washer has a rectangular shape.

8. The clip system of claim 1, wherein the cutout is formed as a first cutout and a second cutout extending from one side to the opposite side thereof, thus forming a pair of channels with the cutout, each of the first cutout and second cutout is operable to receive opposing sides of one of the first and second clip eyelets.

9. The clip system of claim 1, wherein the clip return bend is formed with a clip return angle from about 30 to about 80 degrees.

10. The clip system of claim 1, wherein the first and second eyelets have a spacing therebetween that is user adjustable due to a flexibility of the clip component.

11. A clip system comprising:

a clip component comprising:

first and second clip eyelets spaced apart from each other;

first and second clip legs extending downward from respective first and second clip eyelets; and a clip return formed by forming a clip return bend in each of the first and second clip legs, angling each of the first and second clip legs upward, and interconnecting ends of the first and second clip legs; and first and second clip retaining washers comprising:

a mounting hole formed through a thickness of each of the first and second clip retaining washers; and a cutout formed by partially removing the thickness of each of the first and second clip retaining washers from one side to an opposite side thereof, thus forming a channel with the cutout, wherein:

the first and second clip eyelets are formed in an oblong shape, the oblong shape having a major axis extending along a vertical direction of the clip;

each of the first and second clip retaining washers fit over each respective ones of the first and second clip eyelets, with each of the first and second clip eyelets fitting into the cutout, and the mounting hole aligning with the first and second clip eyelets, permitting a fastener to be inserted through the mounting hole, through respective first and second clip eyelets, and to an object on which the clip system is mounted;

the first and second clip legs have a clip leg spacing between the clip legs that narrows from the first and second clip eyelets to the clip return; and the first and second clip legs each have a clip leg bend that bend each of the first and second clip legs as a clip leg bend angle.

12. The clip system of claim 11, wherein the clip leg bend angle is from about 130 to about 175 degrees.

13. The clip system of claim 11, wherein the retaining washer has a round shape.

14. The clip system of claim 11, wherein the retaining washer has a rectangular shape.

15. The clip system of claim 11, wherein the cutout is formed as a first cutout and a second cutout extending from one side to the opposite side thereof, thus forming a pair of channels with the cutout, each of the first cutout and second cutout is operable to receive opposing sides of one of the first and second clip eyelets.

16. The clip system of claim 11, wherein the clip return bend is formed with a clip return angle from about 30 to about 80 degrees.

17. A fastening system for retaining a first object on a second object, comprising:

a clip component comprising:

first and second clip eyelets spaced apart from each other;

first and second clip legs extending downward from respective first and second clip eyelets; and a clip return formed by forming a clip return bend in each of the first and second clip legs, angling each of the first and second clip legs upward, and interconnecting ends of the first and second clip legs;

first and second clip retaining washers comprising:

a mounting hole formed through a thickness of each of the first and second clip retaining washers; and a cutout formed by partially removing the thickness of each of the first and second clip retaining washers from one side to an opposite side thereof, thus forming a channel with the cutout;

first and second fasteners operable to extend through the mounting holes, through respective first and second eyelets, and into the first object to mount the clip component to the first object; and a space defined between the first and second legs, the clip return, and the first object, the space operable to removably receive the second therein to attach the first object to the second object, wherein:

the first and second clip eyelets are formed in an oblong shape, the oblong shape having a major axis extending along a vertical direction of the clip;

each of the first and second clip retaining washers fit over each respective ones of the first and second clip eyelets, with each of the first and second clip eyelets fitting into the cutout, and the mounting hole aligning with the first and second clip eyelets.

18. The fastening system of claim 17, wherein a height of the space is adjustable due to the oblong shape of the first and second clip eyelets.

19. The fastening system of claim 17, wherein the first object is selected from the group consisting of a pouch, a bag, a holster, a knife, and a case, and the second object is selected from the group consisting of a belt, a pocket, a fabric, an article of clothing, a bag, a wearable object, or a pack.

* * * * *